US010692433B2

(12) United States Patent
Li

(10) Patent No.: US 10,692,433 B2
(45) Date of Patent: Jun. 23, 2020

(54) EMISSIVE PIXEL ARRAY AND SELF-REFERENCING SYSTEM FOR DRIVING SAME

(71) Applicant: Jasper Display Corp., Hsinchu (TW)

(72) Inventor: Bo Li, Santa Clara, CA (US)

(73) Assignee: JASPER DISPLAY CORP., Hsinchu (TW)

( * ) Notice: Subject to any disclaimer, the term of this patent is extended or adjusted under 35 U.S.C. 154(b) by 0 days.

(21) Appl. No.: 16/459,934

(22) Filed: Jul. 2, 2019

(65) Prior Publication Data

US 2020/0020275 A1 Jan. 16, 2020

Related U.S. Application Data

(60) Provisional application No. 62/696,032, filed on Jul. 10, 2018.

(51) Int. Cl.
*G09G 3/3241* (2016.01)

(52) U.S. Cl.
CPC ... *G09G 3/3241* (2013.01); *G09G 2300/0857* (2013.01); *G09G 2330/028* (2013.01)

(58) Field of Classification Search
CPC .. G09G 3/3241; G09G 3/3648; G09G 3/3258; G09G 3/2018; G09G 3/32; G09G 3/3677; G09G 3/3688; G09G 3/3283; G09G 2330/028; G09G 2300/0857; G09G 2300/0809; G09G 2300/0852; G09G 2300/0828; G09G 2300/0842; G09G 2310/027; G09G 2320/0233; H03M 1/742
See application file for complete search history.

(56) References Cited

U.S. PATENT DOCUMENTS

| | | | | |
|---|---|---|---|---|
| 6,788,231 | B1 * | 9/2004 | Hsueh | G09G 3/3241 341/135 |
| 6,850,216 | B2 * | 2/2005 | Akimoto | G09G 3/3648 345/547 |
| 2002/0041266 | A1 * | 4/2002 | Koyama | G09G 3/3648 345/87 |
| 2002/0135309 | A1 * | 9/2002 | Okuda | G09G 3/325 315/169.1 |
| 2003/0156102 | A1 * | 8/2003 | Kimura | G09G 3/3241 345/204 |

(Continued)

OTHER PUBLICATIONS

DeWitt G. Ong, "Modem MOS Technology: Processes, Devices, and Design", 1984, McGraw-Hill, Inc.

*Primary Examiner* — Christopher E Leiby
(74) *Attorney, Agent, or Firm* — WPAT, PC

(57) ABSTRACT

The present invention is to improve on an emissive display by providing a backplane and modulation system that enables fabrication of multi-color or monochrome LED display systems that operate efficiently and without objectionable image artifacts. One aspect of the present invention is to implement the backplane of an emissive display that offers high precision across an array of pixels and extremely low variation. The present invention uses a large L FET to generate a reference current and then uses the same large L FET to act as a current source mirroring the reference current, thereby ensuring a substantially perfect match between reference current FET and current source FET.

20 Claims, 7 Drawing Sheets

(56) References Cited

U.S. PATENT DOCUMENTS

| | | | | |
|---|---|---|---|---|
| 2005/0001794 | A1* | 1/2005 | Nakanishi | G09G 3/006 345/76 |
| 2005/0200300 | A1* | 9/2005 | Yumoto | G09G 3/3241 315/169.1 |
| 2011/0109299 | A1* | 5/2011 | Chaji | G09G 3/3283 324/76.11 |

* cited by examiner

| Inputs | | Output |
|---|---|---|
| Spos | Refresh | Modulation State |
| 193 | 194 | 195 |
| 0 off | 0 on | 1 off |
| 0 off | 1 off | 1 off |
| 1 on | 0 on | 1 off |
| 1 on | 1 off | 0 on |

EMISSIVE PIXEL ARRAY AND SELF-REFERENCING SYSTEM FOR DRIVING SAME

CROSS REFERENCE TO RELATED APPLICATIONS

This present application claims the benefit of U.S. Provisional Patent Application No. 62/696,032, filed on Jul. 10, 2018.

FIELD OF THE INVENTION

The present invention relates to the design of a backplane useful to drive an array of pixels comprising emissive display elements at each pixel and to the operation of a display fabricated with such a backplane. More particularly, the present invention relates to a backplane and backplane controller operative to pulse-width modulate each emissive pixel of an array of pixels to create a gray scale modulation, wherein the current used to drive each pixel derives from a self-referencing system.

BACKGROUND OF THE INVENTION

Emissive displays have proved useful for a variety of applications. For example, plasma display panels (PDPs) were at one time the leading flat panel display technology. More recently, displays using organic light emitting diode (OLED) technology have gained favor, most recently as a display component for useful devices such as mobile telephones, automobile radios, and many other consumer products. Even some applications that are not display oriented have been postulated, including use as a pixilated emissive device in an additive manufacturing device. Additionally, an emissive display may form part of more general illumination systems such a headlamp system for a motorized vehicle, such as an automobile or a motorcycle. Other general lighting applications are conceived of.

More recently, emissive display system developers have demonstrated emissive displays based on backplanes driving small LEDs with a pitch between adjacent pixels of 8 micrometers (hereafter microns or μm) or less. These small LEDs are commonly termed microLEDs or μLEDs. LEDs are designed to exploit the band gap characteristic of semiconductors in which use of a suitable voltage to drive the LED will cause electrons within the LED to combine with electron holes, resulting in the release of energy in the form of photons, a feature referred to as electroluminescence. Those of skill in the art will recognize that semiconductors suitable for LED applications may include trace amounts of dopant material to facilitate the formation of electron holes by acceptor impurities or inject excess electrons by donor impurities.

The choice of semiconductor materials to form an LED will vary by application. In some applications for visual displays one monochrome color may be desirable, resulting in the use of a single semiconductor material for the LEDs of all pixels. In other applications, a full range of colors may be required, which will result in a requirement for three or more semiconductor materials configured to radiate, for example, red, green and blue or combinations thereof. In the case of additive manufacturing, a semiconductor material may be selected such that it emits radiation at a wavelength suitable for it to act as actinic radiation on a feed material used in the additive manufacturing process. All potential variations are included within the scope of the present invention.

It is well known that a preferred means for controlling the apparent intensity of an LED is pulse width modulation, also referred to as duty cycle modulation. Pulse width modulation is preferred because, as is well known in that art, voltage modulation of an LED often results in a shift in the color emitted by the LED, thereby complicating the task of maintaining color balance within the display. Such pulse width modulation necessarily requires that the rate at which pulses occur must be very rapid compared to the visual characteristics of human vision. This characteristic is typically referred to as critical flicker frequency or flicker fusion frequency. It is the frequency at which a human observer perceives a flashing light as a steady light.

One requirement for some applications of an array of LEDs is to achieve both high precision and extremely low variation in the output of the LEDs. Achieving this requires a different approach than can be achieved using more conventional approaches.

SUMMARY OF THE PRESENT INVENTION

It is therefore an object of the present invention to improve on an emissive display by providing a backplane and modulation system that enables fabrication of multicolor or monochrome LED display systems that operate efficiently and without objectionable image artifacts. One aspect of the present invention is to implement the backplane of an emissive display that offers high precision across an array of pixels and extremely low variation. The present invention uses a large L FET to generate a reference current and then uses the same large L FET to act as a current source mirroring the reference current, thereby ensuring a substantially perfect match between reference current FET and current source FET.

DETAILED DESCRIPTION OF THE INVENTION

Figure 1A:
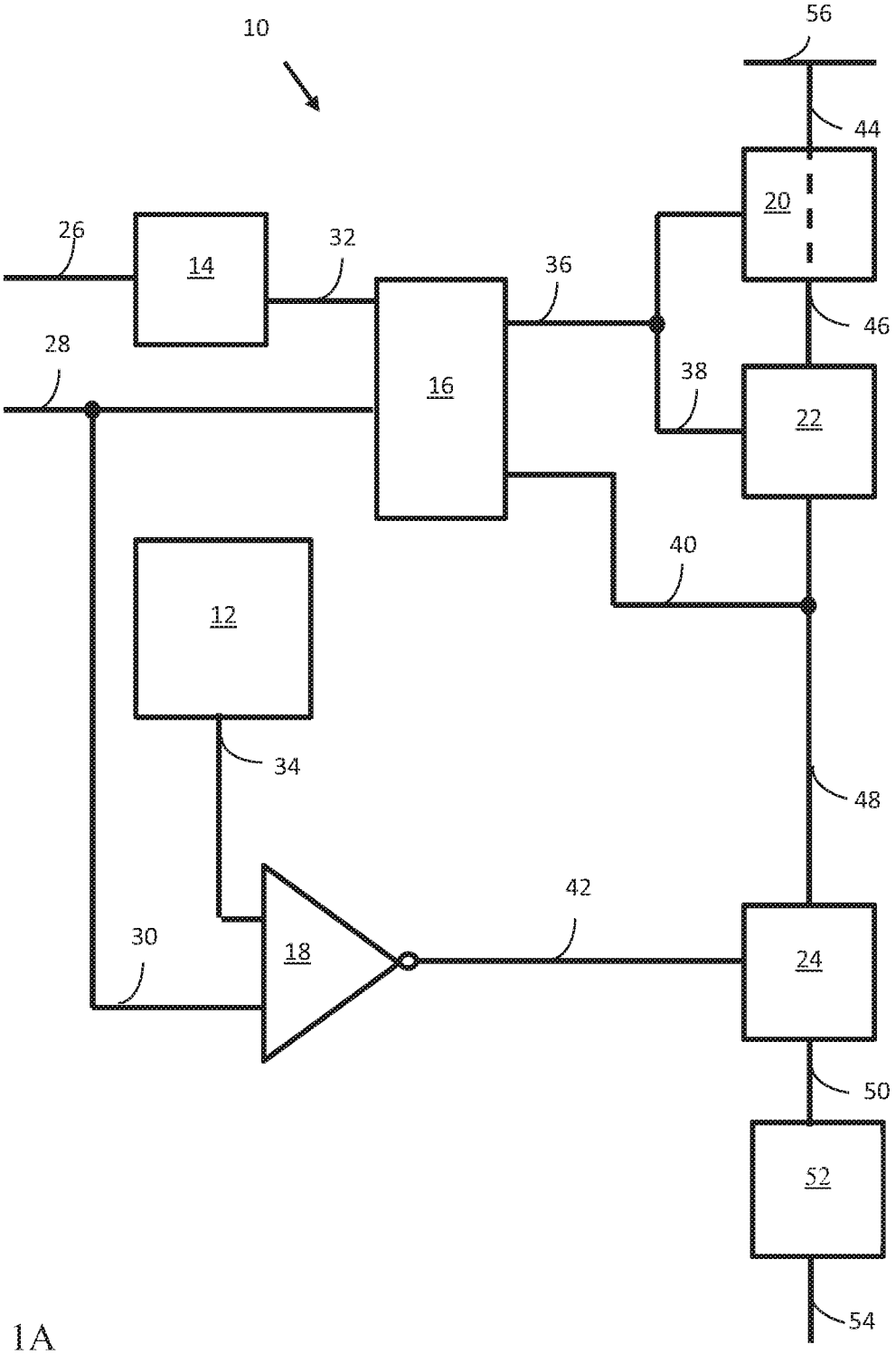
FIG. 1A depicts a block diagram of the driver section of a pixel of an emissive display according to the present invention.

The present application deals with pulse width modulation of an emissive display and use of a pixel driver circuit for the emissive display designed such that it substantially mitigates effects attributable to variations in the components of each pixel driver circuit across an array of pixels through a self-referencing current source implementation.

It is highly desirable for the on-state intensity of all of the LEDs of an array of emissive pixels be of equal instantaneous intensity. It is equally desirable that all LEDs of an array of emissive pixels be of the same color, requiring the same effective voltage across each LED. Achieving this on a semiconductor backplane is difficult, because of IR drop. IR drop is an intrinsic phenomenon of semiconductor integrated circuits that affects the power distribution network, wherein the voltage along a conductor drops the further the point on the conductor is from the voltage source due to resistance in the conductor. In summary, pixels further from the power source have a larger IR drop than those closer to the power source, due to resistance in the distribution network. The power distribution network may be made to be more robust, but IR drop still takes place. It is an object of the present invention to implement a pixel driver circuit that minimizes the effects of IR drop and other phenomena inherent in integrated circuits such as variation of circuit elements across an individual die through the use of a self-referencing current source.

The self-referencing current source of the present specification forms part of a pixel drive circuit, as will be described. The circuit can be reconfigured through the use of a Refresh signal. In a first configuration, Refresh is held high which Although common practice is to use "1" to indicate an "on" state and "0" to indicate an "off" state, this convention is arbitrary and may be reversed, as is well known in the art. The use of the word binary is intended to convey the idea that the modulation data applied to a pixel represents one of two states. Commonly the two states are referred to as on or off. It does not necessarily follow that the duration in time of binary elements of data is also binary weighted. Often, it is desirable to use weightings that conform to a particular gamma curve, as is well known in the art. In emissive displays such as those of the present invention, it is often possible for a pixel of the emissive display to achieve an off state that is truly off, in that no noticeable residual leakage of light from that pixel occurs when the data state of the circuit driving a pixel of the emissive device is placed to off.

The terms conductor and wire shall mean a conductive material, such as copper, aluminum, or polysilicon, operative to carry a modulated or unmodulated voltage or signal. The word terminal is an input or output of a circuit element or collection of elements functioning together. The terms VDDAR, $V_{DDAR}$ and Vddar shall all mean the $V_{DD}$ of an array of pixels and are equivalent terms. The terms VSS, $V_{SS}$, Vss, GND and ground shall mean the $V_{SS}$ of a circuit and are equivalent. SPOS, $S_{POS}$ and Spos shall all mean a signal indicating the data state of a memory cell and are equivalent terms. Refresh is a signal controlling the Refresh state of the pixel circuit. When Refresh is low, the pixel circuit is placed in Refresh mode, and when Refresh is high the pixel circuit is placed in Discharge mode, wherein the LED of the pixel may radiate light if $S_{POS}$ is high (on). The terms Refresh and refresh signal shall have the same meaning. The terms reference current, IREF, $I_{REF}$, and Iref are all references to a reference current from a current source and are equivalent terms. The terms bias voltage, VREF, $V_{REF}$, and Vref are all equivalent and refer to the voltage at which the reference current is delivered. The terms VBIAS, $V_{BIAS}$ and Vbias all are equivalent and refer to an external voltage applied to the gate of a large L FET to establish $V_{REF}$.

The present application makes use of a modified current mirror circuit, the simplest forms of which are well known in the art. A minimal current mirror circuit comprises two p-channel FETs that may be duplicates of each other and one n-channel FET that biases the current to a required voltage level. The terminology describing the components of a current mirror circuit is not consistent across various documents. In the present application, the device generating the reference current to be cloned is called a reference current FET and the current it generates is the reference current or $I_{REF}$. The same FET is used for both components as is explained in the text The device that sets the voltage level of the reference current is the bias FET and the voltage level is sets is the reference voltage or $V_{REF}$. Thus the reference is current $I_{REF}$ at potential $V_{REF}$. The device that receives the reference current at the reference voltage is the current source FET. Because the same FET performs both function in the present invention, the terms are identified as associated with modes of operation of the circuit.

FIG. 1A presents a block diagram of pixel circuit 10 after the present invention. Pixel circuit 10 comprises SRAM memory cell 12, NAND gate 18, n-channel current source 14, switch circuit 16, capacitor 20, dual mode p-channel current clone/source 22, p-channel modulation switch FET 24 and LED 52.

The circuit elements are selected such that when Refresh is low the circuit enters a refresh mode of operation in which no current is applied to LED 52 through modulation switch 24, which is placed in an off state, and when Refresh is high the circuit enters a discharge mode of operation, in which current may be applied to LED 52 provided the modulation data bit stored on SRAM cell 12 is in an on state. A bias voltage $V_{BIAS}$ is applied to the gate of bias FET 14 over conductor 26. The output voltage $V_{REF}$ of current source 14 is asserted over conductor 32 onto switch circuit 16. In one embodiment, bias FET 14 is a large L FET configured as a voltage-controlled resistor, responsive to a voltage applied to its gate. $V_{BIAS}$ is a static voltage used to set the voltage level provided by bias source 14. A Refresh signal is periodically applied in a low (on) state to switch circuit 16 over conductor 28 and is applied onto NAND gate 18 over conductor 30. When a Refresh signal in a low state is applied over conductor 28 to switch circuit 16, switch circuit 16 asserts reference voltage $V_{REF}$ onto the gate of self-referencing current clone/source 22 over conductors 36 and 38, onto the gate of CMOS capacitor 20 over conductors 36 and 38 and onto the drain of self-referencing current clone/source 22 over conductor 40. The source of current clone/source 22 is connected to $V_{DDAR}$ over conductors 44 and 46 and the source and drain of CMOS FET 20 are connected to $V_{DDAR}$ over conductor 44. In one embodiment, self-referencing current clone/source 22 is a large L p-channel FET configured to operate as a voltage controller resister, responsive to a voltage applied to its gate.

Because bias FET 14 and current clone/source 22 are effectively in series with each other and with no other circuit elements in this mode, the current on the gate and drain of current clone/source 22 is equal to the current passing through bias FET 14. Thus, in this mode, bias FET 14 is also a current source.

The Refresh signal is also applied to one input terminal of NAND gate 18 over conductor 30. When one input to a two-input channel NAND is low, the output is always high. Since modulation switch 24 is a p-channel FET, a high signal on the gate of modulation switch 24 asserted over conductor 42 will insure modulation switch 24 is in an off (non-conducting) state and therefore LED 52 will not discharge or radiate.

When Refresh is high (off), the high Refresh signal is asserted onto switch circuit 16, which is placed in an off (non-conducting) that isolates reference voltage $V_{REF}$ of bias FET 14 from the gate and drain of current clone/source 22 and from the gate of CMOS capacitor 20. The gate of CMOS capacitor 20 remains connected to the gate of large L p-channel FET 22, thereby asserting the voltage stored on the gate of CMOS capacitor 20 onto the gate of large L self-referencing p-channel FET 22. $V_{DDAR}$ is asserted onto the source of large L FET 22 through conductors 56, 44 and 46. The dashed line within CMOS capacitor signifies that the path from conductor 44 to conductor 46 is uninterrupted. The source and drain of CMOS capacitor 20 are connected together as part of the design of the capacitor, thereby insuring that conductor 44 and conductor 46 are directly connected. Therefore, the voltage $V_{DDAR}$ asserted on the source of self-referencing current clone/source 22 and source and drain of CMOS capacitor 126 and the voltage asserted on the gate of self-referencing current clone/source 22 and the gate of CMOS capacitor 20 during Refresh mode of operation remain unchanged during Discharge mode of operation. In this configuration self-referencing current clone/source 22 operates as a current source rather than a current clone. Therefore, in discharge mode of operation, large L p-channel FET 22 and CMOS capacitor 20 form part of a self-referencing current source configured to drive LED 52 when data state $S_{POS}$ is high.

When Refresh is high (off), the high Refresh signal is also asserted onto one input terminal of NAND gate 18. This configures NAND gate 18 so that, if $S_{POS}$ asserted on NAND gate 18 over conductor 34 is high, then NAND gate 18 will deliver a low (on) signal over conductor 42 to the gate of modulation switch 24. Since modulation switch 24 is a p-channel device, a low signal on its gate will cause it to pass the voltage on its source to its drain. This will in turn deliver that voltage over conductor 50 to the anode of LED 52. The cathode of LED 52 is in turn connect to V_L over conductor 54. In one embodiment, conductor 54 forms a part of a common cathode return system. In one embodiment, V_L is equal to $V_{SS}$.

Figure 1B:
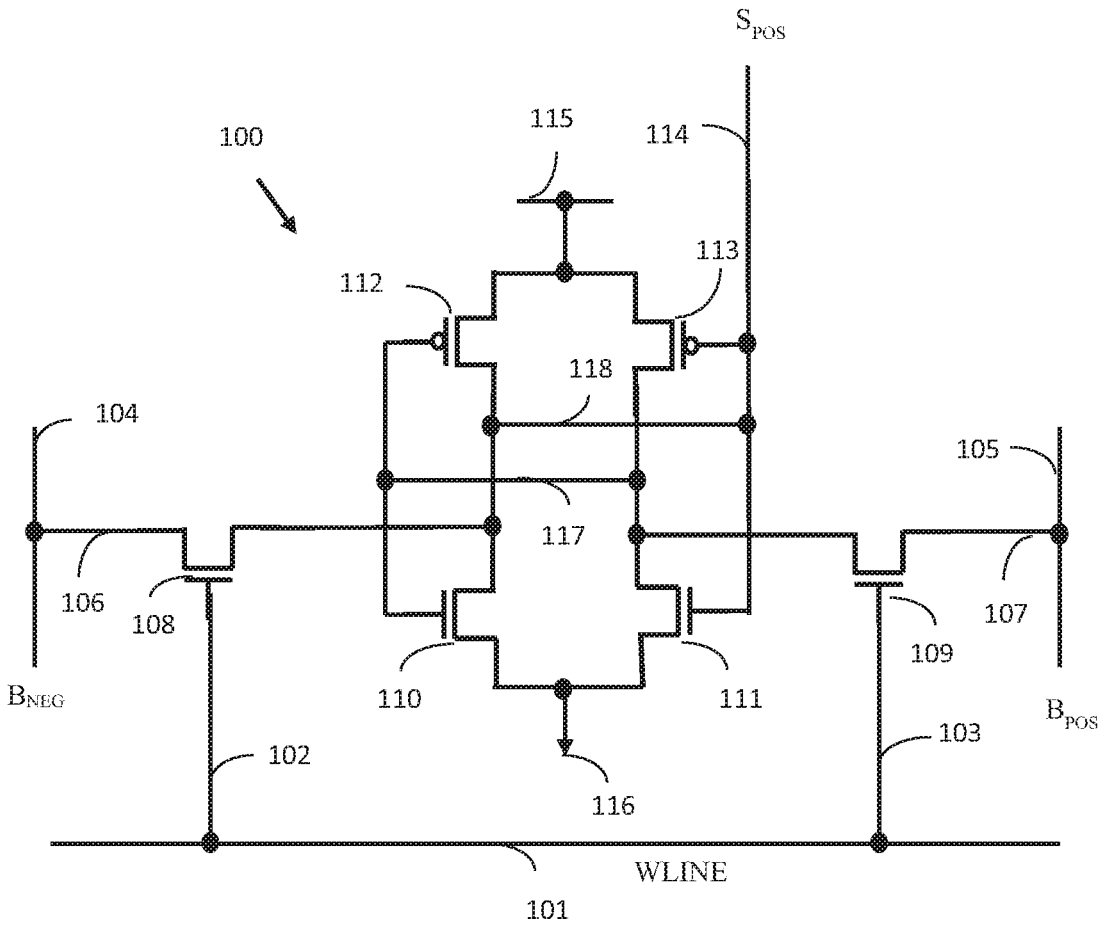
FIG. 1B depicts a schematic drawing of a pixel memory cell of an emissive display.

FIG. 1B presents schematic drawing 100 of a 6-transistor SRAM memory cell. Storage element 100 is preferably a CMOS static ram (SRAM) latch device. Such devices are well known in the art. See DeWitt U. Ong, Modern MOS Technology, Processes, Devices, & Design, 1984, Chapter 9 5, the details of which are hereby fully incorporated by reference into the present application. A static RAM is one in which the data is retained as long as power is applied, though no clocks are running MOSFET transistors 108, 109, 110, and 111 are n-channel transistors, while MOSFET transistors 112, and 113 are p-channel transistors. In this particular design, word line (WLINE) 101, when held high, turns on pass transistors 108 and 109 through conductors 102 and 103 respectively, allowing line ($B_{NEG}$) 104, connected to n-channel pass transistor 108 over line 106, and line ($B_{POS}$) 105, connected to n-channel pass transistor 109 over line 107, to remain at a pre-charged high state or be discharged to a low state by the flip flop (i.e., transistors 112, 113, 110, and 111). The drain of p-channel transistor 112 is connected to the drain of n-channel transistor 110, both of which are cross-linked to the gates of n-channel transistor 111 and p-channel transistor 113 over conductor 118 which connects to conductor 114. The drain of p-channel transistor 113 is connected to the drain of n-channel transistor 111, which are in turn cross linked to the gates of n-channel transistor 110 and p-channel transistor 112 over conductor 117, thereby completing the flip-flop. Differential sensing of the state of the flip-flop is then possible for read operations. In writing data into the selected cell, ($B_{NEG}$) 104 and ($B_{POS}$) 105 are forced high or low by additional column write circuitry (not shown) as is well known in the art. The side that goes to a low value is the one most effective in causing the flip-flop to change state. In the present application, one output port 114 is required to relay to circuitry in the remainder of the pixel circuit (not shown) a signal $S_{POS}$ that indicates whether the data state of the SRAM is in an on state or an off state.

SRAM circuit 100 is connected to $V_{DDAR}$ at conductor 115 and to $V_{SS}$ at conductor 116. $V_{DDAR}$ denotes the $V_{DD}$ for the array. It is common practice to use lower voltage transistors for periphery circuits such as the I/O circuits and control logic of a backplane for a variety of reasons, including the reduction of EMI and the reduced circuit size that this makes possible.

The six-transistor SRAM cell is desired in CMOS type design and manufacturing since it involves the least amount of detailed circuit design and process knowledge and is the safest with respect to noise and other effects that may be hard to estimate before silicon is available. In addition, current processes are dense enough to allow large static RAM arrays. These types of storage elements are therefore desirable in the design and manufacture of liquid crystal on silicon display devices as described herein. However, other types of static RAM cells are contemplated by the present invention, such as a four transistor RAM cell using a NOR gate, as well as using dynamic RAM cells rather than static RAM cells.

The convention in looking at the outputs of an SRAM is to describe the outputs as complementary signals $S_{POS}$ and $S_{NEG}$. The output of memory cell 100 connects the gate of transistors 113 and 111 over conductor 114. This side of the SRAM is conventionally referred as $S_{POS}$. The gates of transistors 112 and 110 are referred to as $S_{NEG}$. Either side can be used provided circuitry, such as an inverter, is added where necessary to insure the proper function of the transistor receiving the output data state of the memory cell.

Figure 1C:
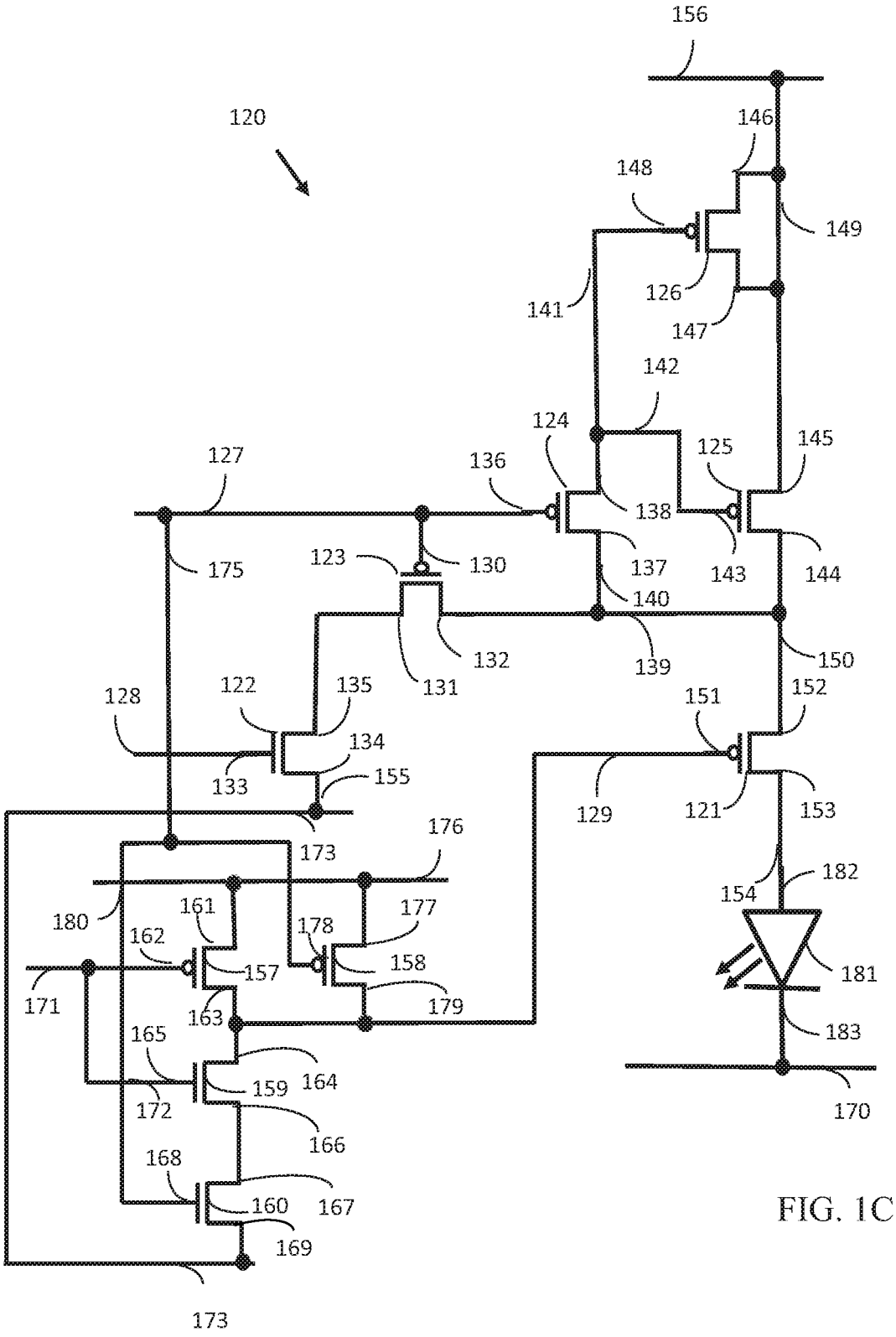
FIG. 1C depicts a schematic drawing of the driver section of a pixel of an emissive display according to the present invention.

FIG. 1C presents emissive pixel driver circuit 120 after block diagram 10 of FIG. 1A, operative, in a discharge mode of operation, to receive a data state logic signal such as $S_{POS}$ and to apply the inverse of that signal to gate 151 of p-channel modulation switch (FET) 121. In a refresh mode of operation, driver circuit 120 receives a refresh signal and applies the inverse of that signal to gate 151 of modulation switch 121, causing modulation switch 121 to block current asserted over conductor 139 and conductor 150 from being applied to LED 181. Driver circuit 120 comprises a NAND gate, bias FET 122, switching FETs 123 and 124, current source FET 125, CMOS capacitor 126, modulation switch and LED 181, wherein the NAND gate comprises p-channel logic FETs 157 and 158 and n-channel logic FETs 159 and 160.

Regarding the circuit elements of the NAND gate, p-channel logic FETs 157 and 158 are placed in parallel, while n-channel logic FETs are placed in series with each other and with p-channel logic FETs 157 and 158. $V_{DDAR}$ is asserted onto source 161 of p-channel FET logic 157 over conductor 176 and onto source 177 of p-channel logic FET 158 over conductor 176. Data state signal $S_{POS}$ is asserted onto gate 162 of p-channel logic FET 157 over conductor 171 and onto gate 165 of n-channel logic FET 159 over conductor 171 and conductor 172. Refresh is asserted onto gate 178 of p-channel logic FET 158 over conductor 180 and onto gate 168 of n-channel logic FET 160, also over conductor 180. Conductor 180 receives Refresh over conductor 175, that in turn receives Refresh over conductor 127. Drain 163 of p-channel logic FET 157, drain 179 of p-channel logic FET 158 and drain 164 of n-channel logic FET 159 are connected to conductor 129 which connected to gate 151 of p-channel modulation switch 121. Source 166 of n-channel logic FET 159 connects to drain 167 of n-channel logic FET 160, and source 169 of n-channel logic FET 160 connects to $V_{SS}$ over conductor 173.

As is commonly known, the signal applied to gate 151 of p-channel modulation switch 121 must be low for modulation switch 121 to conduct between source 152 and drain 153. This can only occur when gate 168 of n-channel logic FET 160 and gate 165 of n-channel logic FET are both high, thereby asserting $V_{SS}$ onto gate 151 of modulation switch 121. For both gates to be high, both $S_{POS}$ and Refresh must be high. All other combinations of $S_{POS}$ and Refresh will result in $V_{DDAR}$ being asserted over conductor 129 onto gate 151 of modulation switch 121, because if at least one of $S_{POS}$ and Refresh is low, then at least one of n-channel logic FETs 159 and 160 will be off (nonconducting) thereby breaking the circuit between conductor 173 ($V_{SS}$) and conductor 129. Likewise, if at least one of $S_{POS}$ and Refresh is low, then at least one of gate 162 of logic FET 157 and gate 178 of logic FET 158 will be set to a conducting (on) state, thereby connecting conductor 176 ($V_{DDAR}$) to conductor 129, thereby turning p-channel modulation switch 121 to an off (nonconducting) condition. This establishes that the NAND gate circuit elements only allow the LED to radiate light when Refresh is high (off) and $S_{POS}$ is high (on.) Other 2-input, single output NAND gate circuit implementations are known in the art and use of any of these alternative implementations in the manner described herein is anticipated in the present invention.

Refresh signal asserted over conductor 127 onto gate 130 of p-channel switching FET 123 and onto gate 136 of p-channel switching FET 124 causes p-channel switching FETs 123 and 124 to conduct when Refresh is in a low (on) state. Bias voltage $V_{BIAS}$ is asserted onto gate 133 of large L n-channel bias FET 122 over conductor 128. Large L n-channel FET 122 acts as a bias FET operative to supply a set bias voltage. Large L n-channel FET 122 is operated in saturation so that it behaves as a voltage-controlled resistor. When a large L FET is used in saturation, the circuit element becomes relatively insensitive to the circuit voltage disturbances common in CMOS integrated circuits. Source 134 of large L n-channel bias FET 122 connects to $V_{SS}$ over conductor 155 which connects to conductor 173. Drain 135 of large L n-channel bias FET 122 is connected to drain 131 of p-channel switch FET 123. When Refresh is low (on), switch FET 123 connects reference voltage $V_{REF}$ asserted on its drain 133 onto its source 132 and thereby onto conductor 139. Conductor 139 passes reference voltage $V_{REF}$ to conductor 140 and conductor 150. Because Refresh signal, when on (low), always insures that modulation switch 121 is off through the NAND gate, no current passes through modulation switch 121 to LED 181. Therefore, only large L p-channel FET 125 and CMOS capacitor 126 are affected by reference voltage $V_{REF}$.

Large L p-channel FET 125 is connected to reference voltage $V_{REF}$ on drain 144 through conductor 150. Large L p-channel FET 125 receives reference voltage $V_{REF}$ on gate 143 through switching FET 124. Reference voltage $V_{REF}$ on conductor 140 is asserted on drain 137 of switching FET 124. Because Refresh signal asserted on gate 136 of p-channel switching FET 124 is low (on), switching FET 124 passes reference voltage $V_{REF}$ to its source 138 which asserts reference current $I_{REF}$ onto conductor 141 and through conductor 141 onto conductor 142. Conductor 142 asserts reference current $I_{REF}$ on gate 143 of large L p-channel FET 125. Conductor 141 asserts reference current $I_{REF}$ on gate 148 of CMOS capacitor 126. CMOS capacitor 126 is a FET with its drain 147 and source 146 electrically connected together by conductor 149. Source 145 of large L p-channel FET 125 and drain 147 and source 146 of p-channel CMOS capacitor 126 are all connected by conductor 149 through conductor 156 to $V_{DDAR}$. CMOS capacitor 126 is operated in inversion mode, Capacitors other than CMOS capacitors are available in some processes and may be used in place of a CMOS capacitor. For example, capacitors may be made in trench form with a number of different dielectric materials, in ONO (silicon oxide-nitride oxide-silicon oxide) material, metal-dielectric-metal form, and in various other forms. The choice of capacitor will depend on its availability in the version of the process available at the target foundry. CMOS capacitors may be operated in modes other than inversion mode. In particular, accumulation mode is a candidate although the design of the circuits around must change somewhat to accommodate it.

Large L p-channel FET 125 is operated in saturation, thus enabling it to operate as a voltage-controlled resistor, wherein the voltage applied to gate 143 determines the effective resistance. The use of a large channel length (or long channel) raises the impedance of the circuit, which improves its ability to function with relatively low noise from various sources, such as power supply or thermal variation.

In Refresh mode, drain 144 and gate 143 of large L p-channel FET 125 are effectively tied to each other through p-channel switch 124 and to reference voltage $V_{REF}$ by the connections through switching FET 123 and switching FET 124. Large L p-channel FET 125 operates as a current source in this mode. The circuit more precisely acts as a current clone, operative to duplicate the reference current through the selection of an appropriate W/L ratio during the design of the circuit, as is well known in the art. Because large L p-channel FET 125 and large L n-channel FET 122 are in series only with each other, the current through the two FETs must be identical.

The buildup of charge in CMOS capacitor enables the operation of pixel driver circuit 120 in discharge mode. In discharge mode, Refresh is set high (off), which configures the NAND gate so that operation of modulation switch 121 is controlled by the data state of $S_{POS}$. When Refresh is set high, switch FETs 123 and 124 are set to off (non-conducting) state, which interrupts the circuit connecting the voltage output $V_{REF}$ of large L n-channel FET 122 to gate 143 of large L p-channel FET, to drain 144 of FET 122 and to gate 148 of CMOS capacitor 126. In discharge mode, gate 143 of large L p-channel FET 125 is disconnected from $V_{REF}$ and, as a result, is only connected to gate 148 of CMOS capacitor 125 over conductors 142 and 141.

As previously noted, in Refresh mode current source large L n-channel FET 122 is in series with large L p-channel current source 125. Since the two parts of the circuit are in series, the current through each is identical In Refresh mode, Large L n-channel FET 122 and large L p-channel FET 125 are both electrically connected to gate 148 of CMOS capacitor 126. Source 146 and drain 147 of CMOS capacitor 126 are electrically connected to source 145 of large L p-channel FET 125. Thus, the charge applied to gate 148 of CMOS capacitor 125, during refresh is the voltage $V_{REF}$ associated with $I_{REF}$, which is also applied to applied to gate 143 of large L p-channel FET 125.

In Discharge mode, large L p-channel FET 125 no longer connects to the drain of Large L n-channel FET 122 because switching FET 123 and switching FET 124 are off (non-conducting) and therefore reference voltage $V_{REF}$ no longer is asserted by the drain of large L FET 122 onto gate 143 of large L p-channel FET 125 or onto gate 148 of CMOS capacitor 126. However, the charge stored on CMOS capacitor 126 is now identical to $V_{REF}$ associated with reference current $I_{REF}$ during Refresh mode. Since $V_{DDAR}$ is asserted onto source 145 of large L p-channel FET over conductor 149 and conductor 156 and onto source 146 and drain 147 of CMOS capacitor 126 in both Refresh mode of operation and Discharge mode of operation, the net voltage difference between source 145 and gate 143 of large L p-channel FET 125 when Discharge mode of operation is initiated is substantially unchanged from the end of Refresh mode of operation when CMOS capacitor 125 is fully or nearly fully charged. Long experience has taught that there are many charge leakage paths present in semiconductors of any sort, which explains the need for a Refresh mode in the present circuit. Therefore, there can be no expectation that the precise voltage to which CMOS capacitor 126 is charge can be held there indefinitely.

In Discharge mode, circuit elements CMOS capacitor 126 and large L p-channel FET 125, as connected, form a current source. $V_{DDAR}$ is asserted onto source 146 and drain 147 of CMOS capacitor 126 and onto the source of large L p-channel FET 125 over conductors 156 and 149. Gate 148 of CMOS capacitor 126 is connected to gate 143 of large L p-channel FET 125 over conductors 141 and 142. Drain 146 of large L p-channel FET 125 asserts the output of FET 125 onto source 152 of modulation switch 121, which in turn connects source 152 to drain 153 when the signal on gate 151 of modulation switch 121 is low (on.) This enables the current to be asserted onto anode 182 of LED 181 over conductor 154. Cathode 183 of LED 181 connects to V_L over conductor 170. This completes the path necessary for LED 181 to emit light. LED 181 provides the most substantial load for the current source. V_L may be a universal common cathode voltage asserted over a single bus. V_L may be a common cathode voltage asserted over a single bus for μLEDs of one wavelength while a different bus with a different value for V_L may be used for μLEDs of a different wavelength. In one embodiment, V_L may be equal to $V_{SS}$.

In Discharge mode, the NAND gate circuit comprising logic FETs 157, 158, 159 and 160 operate as previously described. Because the output of the NAND gate can only be low (on) when $S_{POS}$, in an on (high) state, is applied to gate 165 of n-channel logic FET 159 and Refresh, in an off (high) state, is applied to gate 168 of n-channel logic FET 160, Therefore, in discharge mode, only the data state of $S_{POS}$ determines whether or not p-channel modulation switch 121 connects the current output of large L p-channel FET 125 to anode 182 of LED 181.

In one embodiment, the NAND gate comprising FETs 157, 158, 159 and 160 is replaced by an inverter (not shown) with the Refresh signal as its input and a connection to modulation FET 121 as its output. The signal $S_{POS}$ from a memory cell is eliminated. LED 181 may be replaced by any load. In this mode, pixel drive circuit 120 becomes a self-referencing current source for any application requiring a current source.

Figures 2A, 2B:
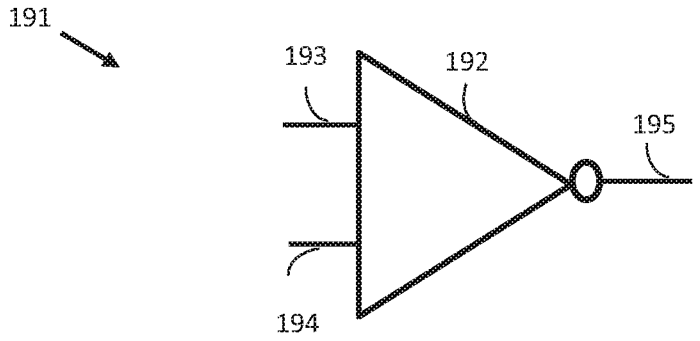
FIG. 2A depicts a NAND gate forming an element of the driver section of a pixel of an emissive display.
FIG. 2B is a truth table providing output states as a function of the data state of a pixel memory cell and of a Refresh signal.

FIG. 2A depicts two-input NAND gate 191. NAND gate 191 comprises NAND gate circuitry 192, input terminals 193 and 194 and output terminal 195. $S_{POS}$ data state signal and Refresh signal act as inputs to terminals 193 and 194 and the resulting signal on output terminal 195 is asserted on a modulation switch. In one embodiment, NAND gate 191 comprises two p-channel switch FETs and two n-channel switch FETs, such as p-channel logic FETs 157 and 158 and n-channel logic FETs 159 and 160 of circuit 120 of FIG. 1C.

FIG. 2B presents the truth table for the inputs to NAND gate 191. Image data state $S_{POS}$ is asserted on input terminal 193. A data state of 0 for $S_{POS}$ is the off state and a data state of 1 is the on state. The alternative arrangement is possible but not used here. The refresh signal is asserted on terminal 194. When the refresh signal is low, pixel driver circuit 120 of FIG. 2C operates in a refresh mode and the state of $S_{POS}$ is irrelevant. When the refresh signal is high, pixel driver circuit 120 operates in a discharge mode, wherein the data state input on terminal 192 determines whether or not modulation switch 121 of FIG. 1C discharges current onto LED 181 of FIG. 1C, thereby causing it to emit light. The resulting signal asserted on output terminal 195 is off for all conditions except the case when image data state $S_{POS}$ is high (on) and the refresh signal is high (off). This set of outcomes is driven by the circuit configuration of any NAND gate of any circuit design and by the use of a p-channel FET as the modulation switch.

Figure 3A:
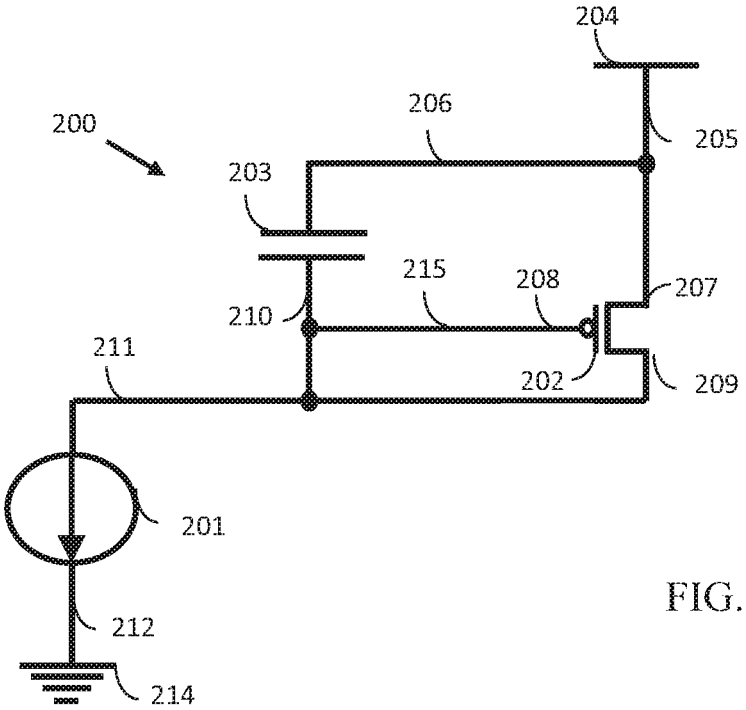
FIG. 3A depicts the drive current state of a driver section of a pixel of an emissive display when the circuit is in Refresh mode.

FIG. 3A depicts a simplified schematic diagram 200 based on pixel driver circuit 120 of FIG. 1C in refresh mode. In this paragraph, numerous references are made to driver circuit 120 of FIG. 1C. In refresh mode, switching FETs 123 and 124 of FIG. 1C are switched on and therefore are represented by the electrical path that exists between source and drain, shown in FIG. 2A as conductors 211 and 210. Modulation switch 121 of FIG. 1C is switched off so the circuit associated with it and LED 181 are not shown. Simplified pixel driver circuit 200 comprises current source 201, CMOS capacitor 203 and self-referencing large L p-channel current source FET 202. The simplest form of a current source is a resistor in series with a voltage source. Current source 201 is analogous to large L n-channel FET 122 of FIG. 1C. Current source 201 is also connected to ground ($V_{SS}$) 214 over conductor 212. As previously noted, large L n-channel FET 122 acts as a current source controlled by a bias voltage $V_{BIAS}$ applied to gate 133. Large L p-channel FET 202 is effectively connected as a current source with its source connected to $V_{DDAR}$ over conductors 205 and 204 with its drain 209 and gate 208 effectively connected to each other and to current source 201 that mirrors current source 201 over conductors 215, 210 and 211. In this mode of the circuit, FET 202 is designed to act as a current clone, that duplicates the current of current source 201 since it is connected in series with current source 201. CMOS capacitor 203 develops charge based on the voltage delivered from current source 201 over conductors 211 and 210 on one side and on $V_{DDAR}$ asserted onto the other side of CMOS capacitor 203 through conductors 206, 205 and 204. The design of CMOS capacitor is determined in part by the frequency at which it is refreshed, in that a capacitor refreshed more often may be smaller than a capacitor refreshed less often that must therefore hold charge longer.

Figure 3B:
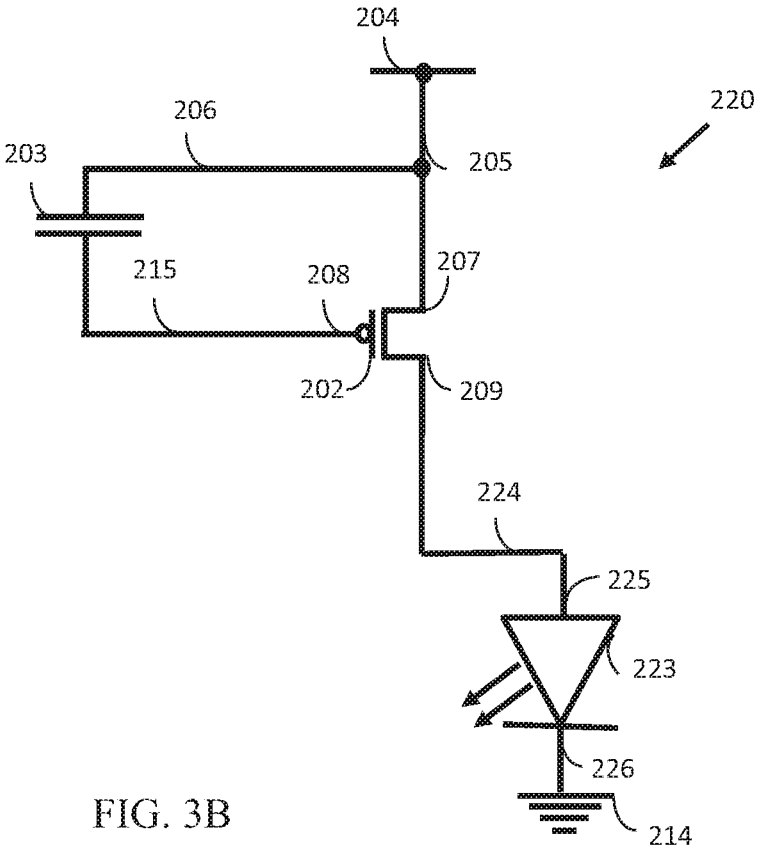
FIG. 3B depicts the drive current state of a driver section of a pixel of an emissive display when the circuit is in Discharge mode.

FIG. 3B depicts a simplified schematic 220 that depicts the active driver circuit elements of pixel driver circuit 120 of FIG. 1C, when driver circuit 120 is driven in discharge mode. Simplified driver circuit 220 depicts essential elements CMOS capacitor 203, self-referencing large L p-channel FET 202 and LED 223. A modulation FET operating in conduct mode similar to modulation switch 121 of FIG. 1C is represented by conductor 224, showing that the electrical path from current source 202 to LED 223 is completed. A path from $V_{DDAR}$ to V_L follows conductor 204 to conductor 205 to source 207 of large L p-channel FET 202 to drain 209 of FET 202 over conductor 224 to anode 225 of LED 223 to cathode 226 of LED 223 to V_L 216. In one embodiment, V_L is set to $V_{SS}$. CMOS capacitor 203 is connected to $V_{DDAR}$ over conductors 206, 205 and 204, of which conductor 205 is also connected to source 207 of large L p-channel FET 202. The other terminal of CMOS capacitor 203 is connected to gate 208 of FET 202 by conductor 210 which connects to conductor 215. Because CMOS capacitor 203 holds the charge placed on it during the refresh mode of operation, the voltage asserted on source 207 of FET 202 and the voltage asserted on gate 208 of FET 202 are identical to the voltages asserted on gate 208 and source 207 of FET 202 during the refresh mode. In discharge mode large L p-channel FET 202 acts as a current source rather than a current clone or current mirror. Because the voltage asserted on gate 208 of large L p-channel FET 202 by CMOS capacitor 203 is unchanged from the voltage it receives during refresh mode as disclosed for refresh mode 200 of FIG. 3A and because source 207 of large L p-channel FET 202 receives $V_{DDAR}$ as is the case for refresh mode 200 of FIG. 3A, the current source output is unchanged from its output during refresh mode as a current clone as disclosed for FIG. 3A.

Circuit elements CMOS capacitor 203 and large L p-channel FET 202 of FIGS. 3A and 3B create a self-referencing current source as operated in discharge mode. In circuit 200 of FIG. 3A, the charge on CMOS capacitor 203 is established by the operation of large L p-channel FET 202. In circuit 220 of FIG. 3B, large L p-channel FET 202 use the charge stored on CMOS capacitor 202. Those of skill in the art will recognize the inherent accuracy and repeatability of a self-referencing current source.

Figure 4A:
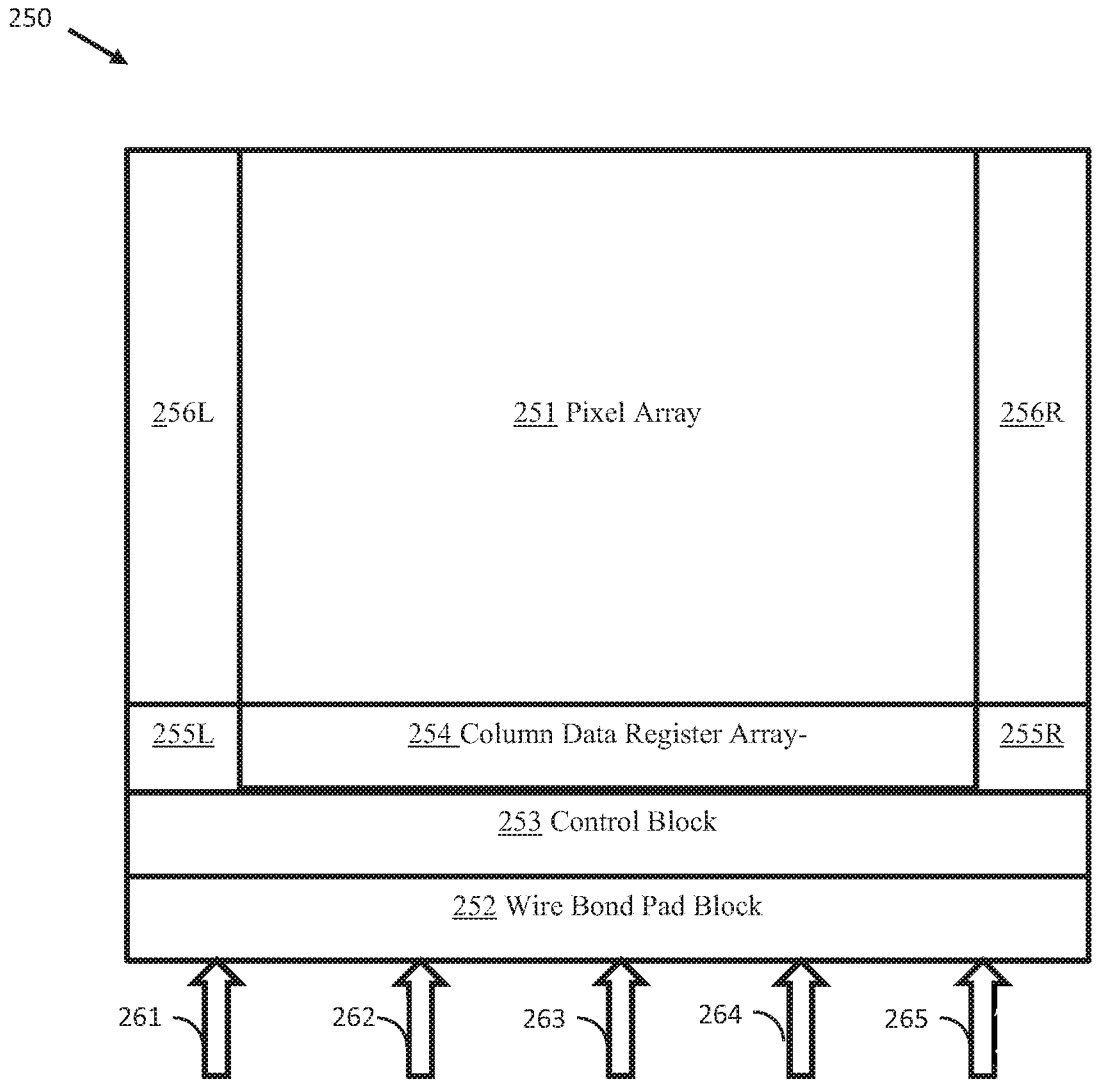
FIG. 4A depicts the elements of an array of pixels of an emissive display.

FIG. 4A presents a functional diagram of the data transfer sections of spatial light modulator (SLM) 250. SLM 250 comprises pixel array 251, left row decoder 256L, right row decoder 256R, column data register array 254, control block 253, and wire bond pad block 252. Wire bond pad block 252 is configured so as to enable contact with an FPCA or other suitable connecting means so as to receive data and control signals over lines from an SLM controller similar to that of FIG. 4A. The data and control signal lines comprise compromise clock signal line 261, op code signal lines 262, serial input-output signal lines 263, refresh control signal line 264, and parallel image data signal lines 265.

Pixel array 251 comprises a plurality of rows and columns (not shown.) Wire bond pad block 252 receives image data and control signals and moves these signals to control block 253. Control block 253 receives the image data and routes the image data to column data register array 254. Row address information is routed to row decoder left 255 and to row decoder right 256. In one embodiment, the value of Op Code line 262 determines whether data received on parallel data signal lines 265 is address information indicating the row to which data is to be loaded or image data to be loaded to a row. In one embodiment the row address information acts as header, appearing first in a time ordered sequence, to be followed by data for that row. In the context of the present application, the word address is most often a noun used to describe the location of the row to be written. The location may be described as an offset from the location (address) of a baseline row or it may be an absolute location of the row to be written. This is similar to the manner in which a Random-Access Memory device, such as an SRAM, is written or read. The use of column addressing, also used in Random-Access Memory devices, may be envisioned, but other mechanisms, such as a shift register, are also envisioned. Use of a shift register to enable the writing of data to rows of the array is also envisioned.

Row decoder left 256L and row decoder right 256R are configured so as to pull the word line for the decoded row high so that data for that row may be transferred from column data register array 254 to the storage elements resident in the pixel cells of that row of pixel array 251. In one embodiment, row decoder left 256L pulls the word line high for a left half of the display, and row decoder right 256R pulls the word line high for a right half of the display.

A refresh signal delivered over refresh signal line 264 is sent to refresh signal distribution circuits 255L and 255R, which in turn deliver the refresh signals to the pixels of pixel array 251. In one embodiment, the refresh signal is a global signal delivered to all pixels of the array. In one embodiment, the refresh signal ripples down rows of the display the display in a fixed time, such as one microsecond (1 μsec) to reduce instantaneous current spike effects. In one embodiment, pixels of the same color of array of pixels 251 receive refresh signals that differ from the refresh signal for pixels of a different color.

Figure 4B:
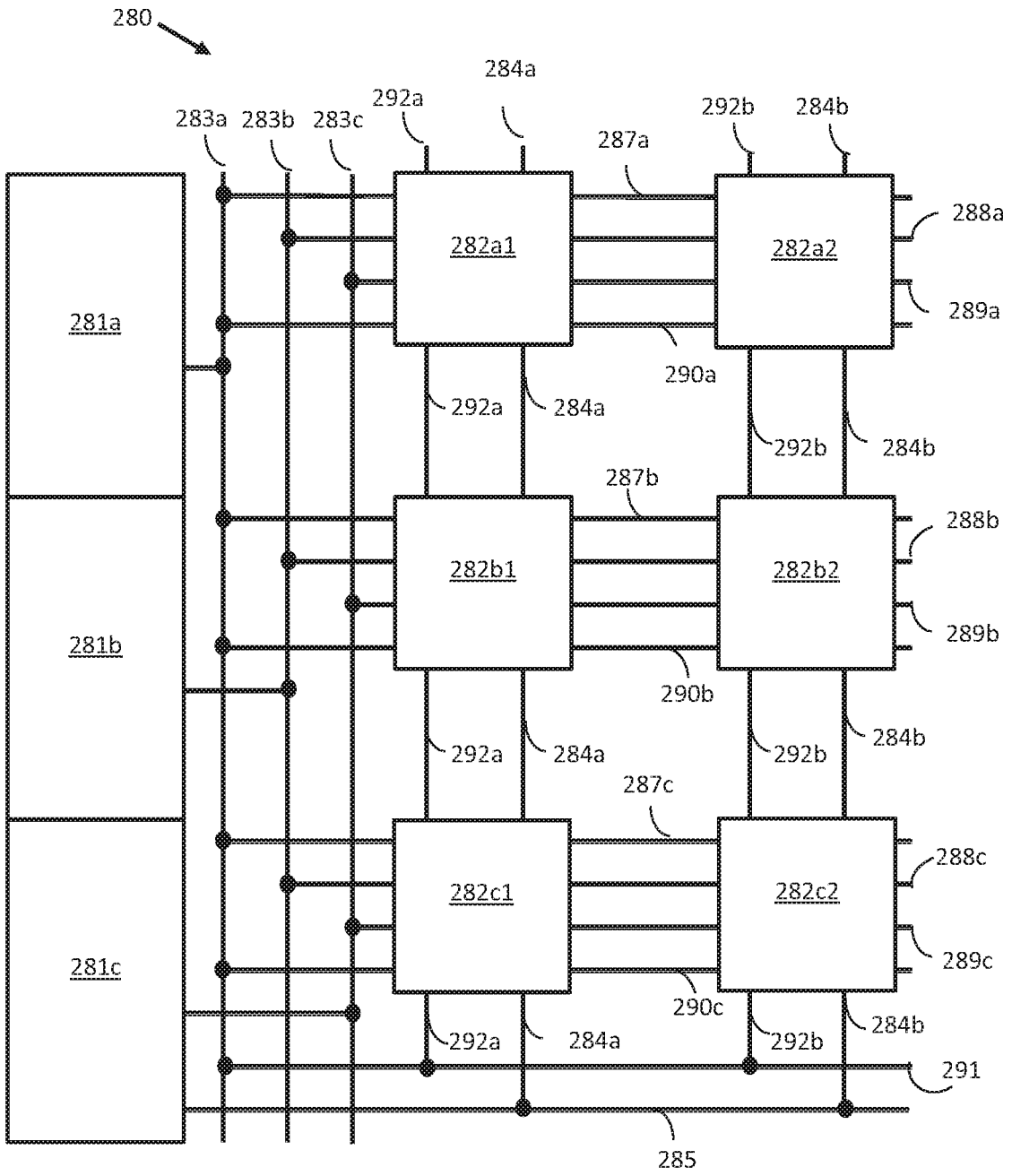
FIG. 4B depicts a simplified diagram of display controller interfaces with an array of pixels.

FIG. 4B depicts a simplified diagram 280 of display controller interfaces with an array of pixels. A display controller comprises state voltage section 281*a*, signal voltage control section 281*b* and data memory and logic control section 281*c*. A first row of pixels comprises pixel 282*a*1 and pixel 282*a*2. A second row of pixels comprises pixel 282*b*1 and pixel 282*b*2. A third row of pixels comprises pixel 282*c*1 and pixel 282*c*2. A first column of pixels comprises pixel 282*a*1, pixel 282*b*1 and pixel 282*c*1. A second column of pixels comprises pixel 282*a*2, pixel 282*b*2 and pixel 282*c*2. The choice of this number of pixels is for ease of reference and is not limiting upon this disclosure. Arrays of pixels comprising in excess of 1000 rows and 1000 columns are commonplace in display products.

Static voltage section 281*a* provides a range of voltages required to operate the array of pixels, such as $V_{DDAR}$, $V_{SS}$ and reference voltage $V_{REF}$ onto static voltage distribution bus 283*a*. Static voltage distribution bus 283*a* distributes $V_{DDAR}$ to the pixels of a first row over conductor 287*a*, to the pixels of a second row over conductor 287*b* and to the pixels of a third row over conductor 287*c*. Static voltage distribution bus 283*a* distributes $V_{SS}$ to the pixels of a first row over conductor 290*a*, to the pixels of a second row over conductor 290*b* and to the pixels of a third row over conductor 290*c*. Static voltage distribution bus 283*a* distributes $V_{REF}$ to bus 291, which in turn distributes $V_{REF}$ to the pixels of a first column over conductor 292*a* and to the pixels of a second column over conductor 292*b*. The choice of bus orientation is an engineering design consideration not limiting upon this disclosure.

Signal voltage control section 281*b* delivers control signals required to operate the array of pixels, such as Refresh and word line (WLINE) high for the selected row, over bus 283*b*. Signal voltage control 281*b* delivers signals to signal voltage distribution bus 283*b*, which in turn delivers the signals to the pixels of a first row over conductor 288*a*, to the pixels of a second row over conductor 288*b* and to the pixels of a third row over conductor 288*c*. Conductors 288*a*, 288*b* and 288*c* each may comprise a plurality of conductors such that each control signal is delivered independently of other control signals. The row on which WLINE is to be held high is selected by a row decoder circuit (not shown).

Data memory and logic control section 281*c* performs several functions. It may, for example, process data in a standard 8-bit or 12-bit format into a form usable to pulse-width modulate a display. A first function is to select a row for data to be written to and a second function is to load the data to be written to that row. Data memory and logic control section 281*c* loads image data onto the column drivers (not shown) for each column over bus 285. Conductor 284*a*, conductor 284*b* and conductor 284*c* each represent complementary bit lines operative to transfer data from the column drivers to the memory cell of each pixel of the selected row. Data memory and logic control section 281*c* the loads the selected address information onto address data bus 283*c*, which acts to select the correct row using row decoder circuitry (not shown). When WLINE for the selected row is held high, the data on the column drivers are loaded into the memory cell of each pixel of the selected row. The word line for the selected row is one of conductor 289*a*, conductor 289*b* or conductor 289*c*, as determined by the row decoder.

This with experience of the art will recognize alternative implementations and variations that may be implemented using the disclosure of this application. All are encompassed within the present disclosure.

What is claimed is:

1. A pixel drive circuit operative to function in a plurality of modes, wherein the modes comprise a discharge mode of operation and in a refresh mode of operation, the drive circuit comprising a large L bias FET configured to provide a reference voltage based on a bias voltage on its gate; a large L FET configured as a current source; a capacitor operative to hold a stored voltage between the source and gate of the large L current source; a memory cell operative to hold an illumination state and assert that state on a modulation FET when the pixel drive circuit is in discharge mode; a modulation FET operative to modulate a current from the large L current source; a NAND gate operative to place the modulation FET in a non-conduct mode when the pixel drive circuit operates in a refresh mode or when the memory cell illumination state is off; and, a terminal to receive a refresh signal and switching FETs operative to configure the pixel drive circuit based on the refresh signal, and wherein the pixel drive circuit operates in a refresh mode based on a first state of a refresh signal and in a discharge mode based on a second state of a refresh signal, and wherein in a refresh mode of operation, the gate and drain of the large L current source FET connect to the drain of the bias FET, asserting the reference voltage on the gate and drain of the current source FET and on the capacitor operative to hold a stored voltage between the source and gate of the current source FET, thereby charging the capacitor to the reference voltage, and wherein the voltage asserted on the source of the current source FET is one of $V_{DDAR}$ and $V_{SS}$, and the voltage asserted on the source of the bias FET is the other of $V_{SS}$ and $V_{DDAR}$ not asserted on the source of the current source FET, and wherein in a discharge mode of operation, the gate and drain of the current source FET are disconnected from one another and the drain of the bias FET is disconnected from the gate and drain of the current source FET, and the voltage on the gate of the current source FET is asserted by the capacitor, resulted in the discharge of current from the drain of the current source FET into the LED in those instances where the memory cell illumination state is on.

2. The pixel drive circuit of claim 1, wherein the capacitor is a CMOS capacitor.

3. The pixel drive circuit of claim 2, wherein the CMOS capacitor is operated in inversion mode.

4. The pixel drive circuit of claim 1, wherein the memory cell is an SRAM circuit with complementary outputs, one of which is provides an input signal to a NAND gate.

5. The pixel drive circuit of claim 4, wherein the output of the memory device that is used is $S_{POS}$.

6. The pixel drive circuit of claim 1, wherein the NAND gate comprises a pair of p-channel FETs in parallel and a pair of n-channel FETs in series wherein the n-channel FETs are in series with the two p-channel FETs, and wherein the refresh signal is asserted on the gate of one p-channel FET and on the gate of one n-channel FET and wherein the output of the memory cell is asserted on the gate of the remaining p-channel FET and on the gate of the remaining n-channel FET.

7. The pixel drive circuit of claim 1, wherein the current source FET is a p-channel FET with its source connected to $V_{DDAR}$ and the bias FET is an n-channel FET with its source connected to $V_{SS}$.

8. The pixel drive circuit of claim 7, wherein, in discharge mode, the drain of the current source FET is connected through a modulation FET to the anode of a light emitting diode.

9. The pixel drive circuit of claim 8, wherein the cathode of the LED is electrically connected to the cathodes of all LEDs in a common cathode arrangement.

10. The pixel drive circuit of claim 8, wherein the cathode of the LED is connected to a universal voltage V_L.

11. The pixel drive circuit of claim 10, wherein the universal voltage V_L is equal to $V_{SS}$.

12. A current source circuit operative to function in a plurality of modes, wherein the modes comprise a discharge mode of operation and in a refresh mode of operation, the current source circuit comprising:

a large L bias FET configured to provide a reference voltage based on a bias voltage on its gate, a large L FET configured as a current source, a capacitor operative to hold a stored voltage between the source and gate of the large L current source, a switch FET operative to switch on or off a current from the large L current source, an inverter operative to place the switch FET in a non-conduct mode when the current source circuit operates in a refresh mode, a terminal to receive a refresh signal and switching FETs operative to configure the current source circuit based on the refresh signal, and wherein the current source circuit operates in a refresh mode based on a first state of a refresh signal and in a discharge mode based on a second state of a refresh signal, and wherein in a refresh mode of operation, the gate and drain of the large L current source FET connect to the drain of the bias FET, asserting the reference voltage on the gate and drain of the current source FET and on the capacitor operative to hold a stored voltage between the source and gate of the current source FET, thereby charging the capacitor to the reference voltage, and wherein the voltage asserted on the source of the current source FET is one of $V_{DDAR}$ and $V_{SS}$, and the voltage asserted on the source of the bias FET is the other of $V_{SS}$ and $V_{DDAR}$ not asserted on the source of the current source FET, and wherein in a discharge mode of operation, the gate and drain of the current source FET are disconnected from one another and the drain of the bias FET is disconnected from the gate and drain of the current source FET, and the voltage on the gate of the current source FET is asserted by the capacitor, resulted in the discharge of current from the drain of the current source FET into a resistive load.

13. The current source circuit of claim 12, wherein the capacitor is a CMOS capacitor.

14. The current source circuit of claim 13, wherein the CMOS capacitor is operated in inversion mode.

15. The current source circuit of claim 12, wherein the NAND gate comprises a pair of p-channel FETs in parallel and a pair of n-channel FETs in series wherein the n-channel FETs are in series with the two p-channel FETs, and wherein the refresh signal is asserted on the gate of one p-channel FET and on the gate of one n-channel FET and wherein the output of the memory cell is asserted on the gate of the remaining p-channel FET and on the gate of the remaining n-channel FET.

16. The current source circuit of claim 12, wherein the current source FET is a p-channel FET with its source connected to $V_{DDAR}$ and the bias FET is an n-channel FET with its source connected to $V_{SS}$.

17. The current source circuit of claim 16, wherein, in discharge mode, the drain of the current source FET is connected through a switch FET to the anode of a light emitting diode.

18. The current source circuit of claim 17, wherein the cathode of the LED is electrically connected to the cathodes of all LEDs in a common cathode arrangement.

19. The current source circuit of claim 17, wherein the cathode of the LED is connected to a universal voltage V_L.

20. The current source circuit of claim 19, wherein the universal voltage V_L is equal to $V_{SS}$.

* * * * *